US011110327B2

(12) United States Patent
Mizutani

(10) Patent No.: US 11,110,327 B2
(45) Date of Patent: Sep. 7, 2021

(54) GOLF CLUB HEAD

(71) Applicant: Sumitomo Rubber Industries, Ltd., Hyogo (JP)

(72) Inventor: Naruhiro Mizutani, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/846,604

(22) Filed: Apr. 13, 2020

(65) Prior Publication Data

US 2020/0338404 A1 Oct. 29, 2020

(30) Foreign Application Priority Data

Apr. 26, 2019 (JP) ..... JP2019-085946

(51) Int. Cl.
*A63B 53/04* (2015.01)

(52) U.S. Cl.
CPC ..... *A63B 53/0466* (2013.01); *A63B 53/045* (2020.08); *A63B 53/0412* (2020.08); *A63B 53/0437* (2020.08); *A63B 2053/0491* (2013.01)

(58) Field of Classification Search
CPC ..... A63B 53/0466; A63B 53/045; A63B 53/0412; A63B 53/0437; A63B 2053/0491; A63B 53/0433; A63B 60/42; A63B 2209/10; A63B 60/54; A63B 60/002; A63B 60/02; A63B 60/50; A63B 2209/02
See application file for complete search history.

(56) References Cited

U.S. PATENT DOCUMENTS

| | | | | |
|---|---|---|---|---|
| 10,569,144 | B2 * | 2/2020 | Nielson | A63B 60/52 |
| 2003/0083151 | A1 | 5/2003 | Nakahara et al. | |
| 2010/0125000 | A1 | 5/2010 | Lee | |
| 2011/0263350 | A1 | 10/2011 | Lee | |
| 2013/0116065 | A1 * | 5/2013 | Yamamoto | A63B 53/04 473/345 |
| 2014/0011605 | A1 | 1/2014 | Lee | |

(Continued)

FOREIGN PATENT DOCUMENTS

| | | | |
|---|---|---|---|
| JP | 2003199848 | A | 7/2003 |
| JP | 2004344295 | A | 12/2004 |

(Continued)

OTHER PUBLICATIONS

An Office Action; "Notification of Reasons for Rejection," issued by the Japanese Patent Office dated Jul. 30, 2019, which corresponds to Japanese Patent Application No. 2019-085946.

(Continued)

*Primary Examiner* — Stephen L Blau
(74) *Attorney, Agent, or Firm* — Studebaker & Brackett PC

(57) ABSTRACT

A golf club head according to the present invention includes a head body and at least one cover member attached to the head body and having a specific gravity smaller than the head body. The head body has an internal space, and includes at least one opening and in communication with the internal space, and at least one bridge portion having a traverse portion that traverses at least the opening and extending along an inner wall surface of the head body. The opening is closed by the cover member, a height of the bridge portion from the inner wall surface of the head body changes in a direction in which the bridge portion extends.

16 Claims, 6 Drawing Sheets

(56) References Cited

U.S. PATENT DOCUMENTS

| | | | | |
|---|---|---|---|---|
| 2017/0173414 | A1 | 6/2017 | Motokawa | |
| 2017/0209750 | A1 | 7/2017 | Lee | |
| 2019/0022478 | A1* | 1/2019 | Greaney ..... | A63B 60/00 |
| 2019/0070469 | A1 | 3/2019 | Lee | |
| 2019/0344136 | A1 | 11/2019 | Lee | |

FOREIGN PATENT DOCUMENTS

| | | | |
|---|---|---|---|
| JP | 3762906 | B2 | 4/2006 |
| JP | 2006230953 | A | 9/2006 |
| JP | 2007244715 | A | 9/2007 |
| JP | 2007275547 | A | 10/2007 |
| JP | 2013121499 | A | 6/2013 |
| JP | 2016198584 | A | 12/2016 |
| JP | 2017113190 | A | 6/2017 |
| JP | 201918019 | A | 2/2019 |

OTHER PUBLICATIONS

An Office Action; "Notification of Reasons for Rejection," issued by the Japanese Patent Office dated Oct. 8, 2019, which corresponds to Japanese Patent Application No. 2019-085946.

* cited by examiner

E1 Cross-section

GOLF CLUB HEAD

TECHNICAL FIELD

The present invention relates to a golf club head.

BACKGROUND ART

Wood-type golf club heads have undergone many refinements heretofore, and various proposals have been made in order to increase the flexibility of center of gravity design. For example, in JP 3762906B, an opening is formed in the head, and a lightweight cover member formed with fiber-reinforced plastic or the like is arranged so as to close this opening. Since the weight of the region to which the cover member is attached is thereby reduced, the saved weight can be distributed to other regions. Thus, the flexibility of center of gravity design improves.

JP 3762906B is an example of related art.

However, there is a problem that the rigidity of the head decreases when the opening is formed. The present invention has been made in order to solve the above problem, and an object thereof is to provide a golf club head that is able to suppress a decrease in the rigidity of the head due to formation of an opening.

SUMMARY OF THE INVENTION

A golf club head according to the present invention includes a head body having a face portion, a crown portion and a sole portion, and at least one cover member attached to the head body and having a specific gravity smaller than the head body, the head body having an internal space surrounded by the face portion, the crown portion and the sole portion, and including at least one opening formed in at least one of the crown portion and the sole portion and in communication with the internal space, and at least one bridge portion having a traverse portion that traverses at least the opening and extending along an inner wall surface of the head body, the opening being closed by the cover member from an outer side of the head body, the bridge portion including a joining surface that contacts the cover member, and a height of the bridge portion from the inner wall surface of the head body changing in a direction in which the bridge portion extends.

In the golf club head, the bridge portion can extend in a toe-heel direction to a vicinity of a toe-side edge portion of the sole portion, and the height of the bridge portion can be formed to become lower proceeding toward the toe-side edge portion of the sole portion.

In the golf club head, the bridge portion can extend in the toe-heel direction to a vicinity of a heel-side edge portion of the sole portion, and the height of the bridge portion can be formed to become lower proceeding toward the heel-side edge portion of the sole portion.

In the golf club head, an installation portion on which a peripheral portion of the cover member is arranged can be formed on a peripheral portion of the opening, a step can be formed at a boundary between an outer edge of the installation portion and an outer surface of the head body, and the golf club head can be constituted such that the peripheral portion of the cover member arranged on the installation portion is substantially flush with the outer surface of the head body.

In the golf club head, a first thin portion having a small thickness can be formed in part of the installation portion.

In the golf club head, in the head body, a second thin portion having a smaller thickness than the installation portion can be formed at least partially around the installation portion.

In the golf club head, a thick portion having a larger thickness than the second thin portion can be formed at least partially around the second thin portion.

In the golf club head, the thick portion can be formed on the toe side and the heel side, sandwiching the opening.

In the golf club head, a configuration can be adopted in which one of the bridge portions extends in the toe-heel direction, the opening is partitioned by the bridge portion that extends in the toe-heel direction into a first opening on a face side and a second opening on a back side, and the first opening has a smaller area than the second opening.

In the golf club head, the opening can be formed on the toe side in the toe-heel direction.

In the golf club head, the opening can be formed in the sole portion.

With the golf club head according to the present invention, a decrease in the rigidity of the head due to formation of an opening can be prevented.

EMBODIMENTS OF THE INVENTION

Hereinafter, an embodiment of a golf club head according to the present invention will be described, with reference to the drawings.

1. Overview of Golf Club Head

Figure 1:
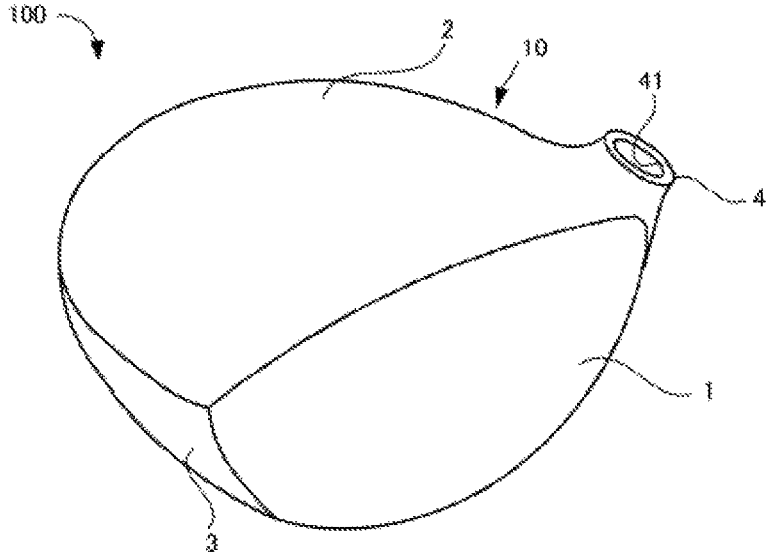
FIG. 1 is a perspective view of a golf club head according to an embodiment.
Figure 2:
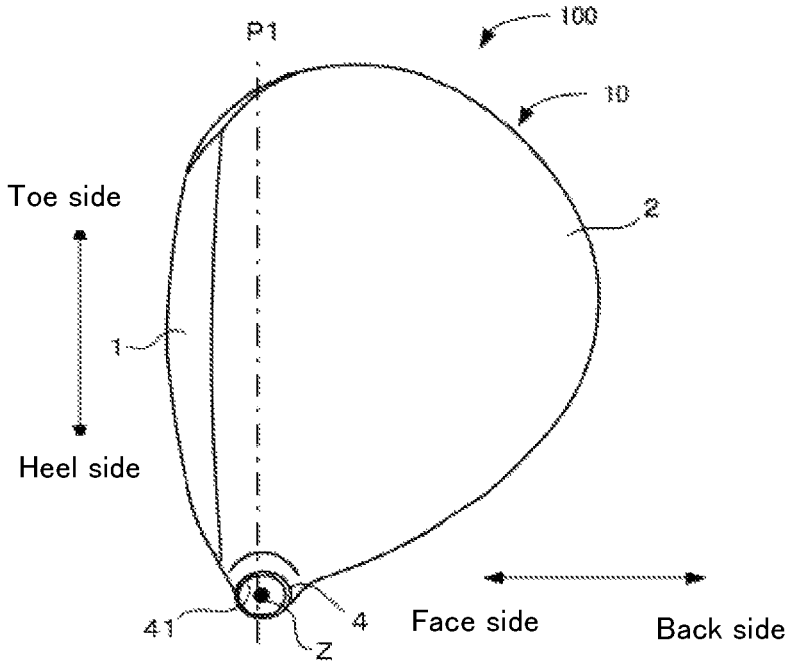
FIG. 2 is a plan view of the golf club head of FIG. 1 in a reference state.
Figure 3:
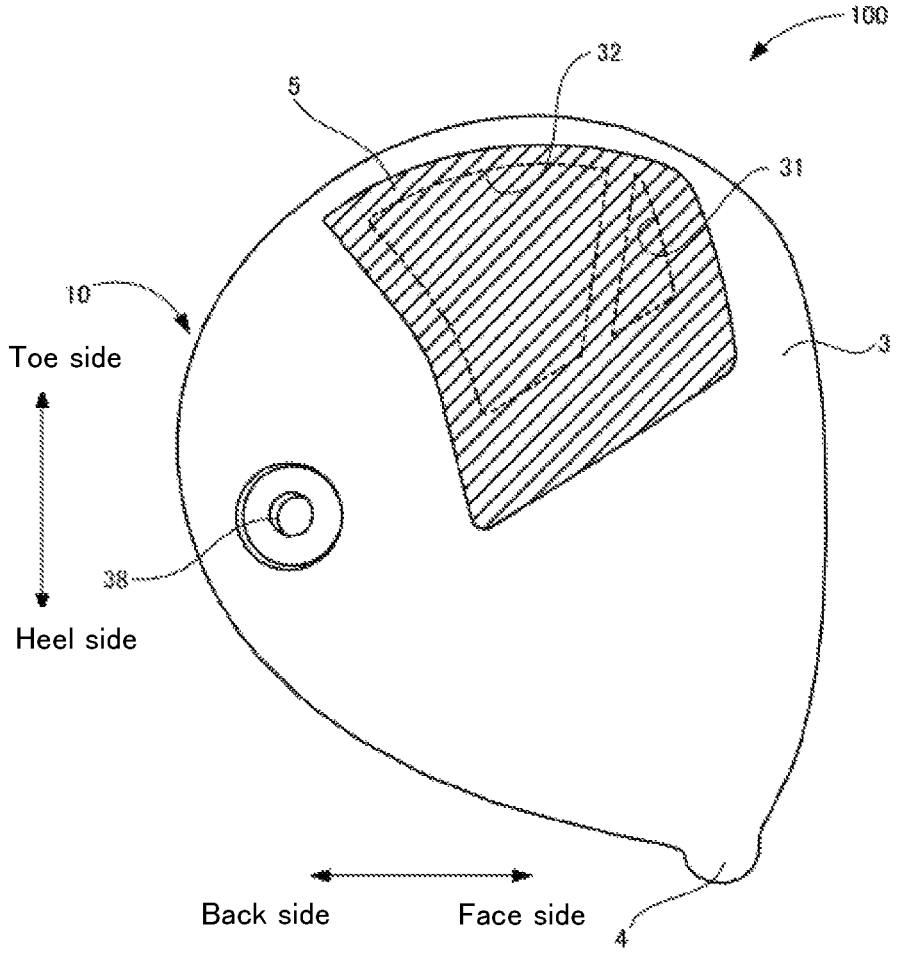
FIG. 3 is a plan view the golf club head in the reference state viewed from below.

FIG. 1 is a perspective view of this golf club head, FIG. 2 is a plan view of the head in a reference state, and FIG. 3 is a plan view of the golf club head in the reference state viewed from below. As shown in FIGS. 1 to 3, this golf club head (hereinafter, may be referred to simply as "head") 100 is a wood-type golf club head having a head body 10 that is a hollow structure having an internal space whose wall surface is formed by a face portion 1, a crown portion 2, a sole portion 3 and a hosel portion 4, and a cover member 5 attached to the sole portion 3 of this head body 10. Specifically, the present invention can be applied to golf club heads such as utilities (hybrids), fairway woods and drivers.

The face portion 1 has a face surface that is the surface that hits the ball, and the crown portion 2 adjoins the face portion 1 and constitutes the upper surface of the head body 10. The sole portion 3 mainly constitutes the bottom surface of the head body 10, and constitutes the outer peripheral surface of the head body 10 other than the face portion 1 and the crown portion 2. That is, in addition to the bottom surface of the head body 10, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which a shaft (illustration omitted) of the golf club is inserted, and that is formed in a cylindrical shape extending inside the head. A center axis line Z of this insertion hole 41 coincides with the axis line of the shaft.

As shown in FIG. 3, a first opening 31 and a second opening 32 are formed in the sole portion 3 as will be discussed later, and the cover member 5 is attached with an adhesive or the like so as to close these openings 31 and 32.

Here, the reference state when setting the golf club head 100 on the ground will be described. First, as shown in FIG. 2, a state where the above center axis line Z is contained in a plane P1 that is perpendicular to the ground and the head is placed on the ground at a predetermined lie angle and real loft angle is prescribed as the reference state. The plane P1 will be referred to as a reference perpendicular plane. Also, as shown in FIG. 2, the direction of the line of intersection between the reference perpendicular plane P1 and the ground will be referred to as a toe-heel direction, and the direction that is perpendicular to this toe-heel direction and parallel to the ground will be referred to as a face-back direction. Also, the direction that is orthogonal to the toe-heel direction and the face-back direction may be referred to as an up-down direction.

Figure 4A:
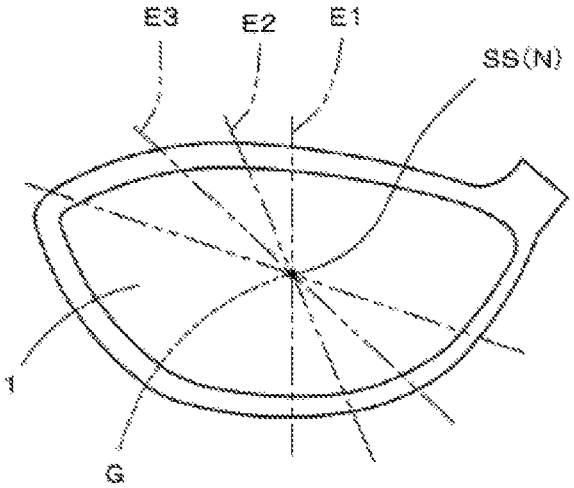
FIG. 4A is a diagram illustrating a boundary of a face portion.
Figure 4B:
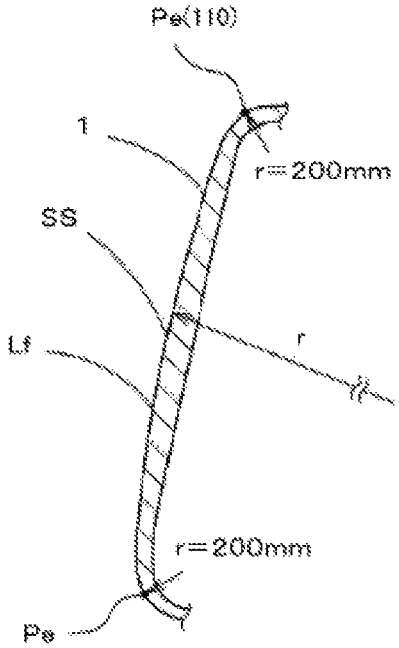
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, then in each of cross-sections E1, E2, E3 and so forth that contain a straight line N connecting a head center of gravity G and a sweet spot SS, as shown in FIG. 4A, a position Pe at which a curvature radius r of a contour line Lf of the face outer surface first reaches 200 mm in a direction toward the outer side of the face from the sweet spot side, as shown in FIG. 4B, will be the periphery of the face portion 1, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour when the head is set in the reference state and viewed from directly above the center of gravity of the head 10 will be the boundary.

The head body 10 can, for example, be formed with a titanium alloy (Ti-6Al-4V, Ti-8Al-1Mo-1V, etc.) having a specific gravity of substantially about 4.3 to 4.5. Apart from a titanium alloy, the head can also be formed using one or two or more materials selected from stainless steel, maraging steel, an aluminum alloy, a magnesium alloy and an amorphous alloy, for example.

On the other hand, the cover member 5 is formed with a material whose specific gravity is smaller than the head body 10, and can, for example, be formed with a material whose specific gravity is 0.9 to 3.0. As such a material, plastics such as polyetheretherketone (PEEK) or polycarbonate (PC), fiber-reinforced plastic, an Mg alloy, an aluminum alloy or the like can be employed, for example. As another viewpoint, the cover member 5 can, for example, also be formed with a material whose Young's modulus is smaller than the head body 10. In this case, Young's modulus of the cover member 5 can be set from 4 MPa to 125 GPa, and Young's modulus of the head body 10 can be set from 100 GPa to 130 GPa.

The volume of this golf club head 100 is desirably from 90 $cm^3$ to 470 $cm^3$ inclusive, for example.

2. Structure of Outer Surface of Sole Portion

Figure 5:
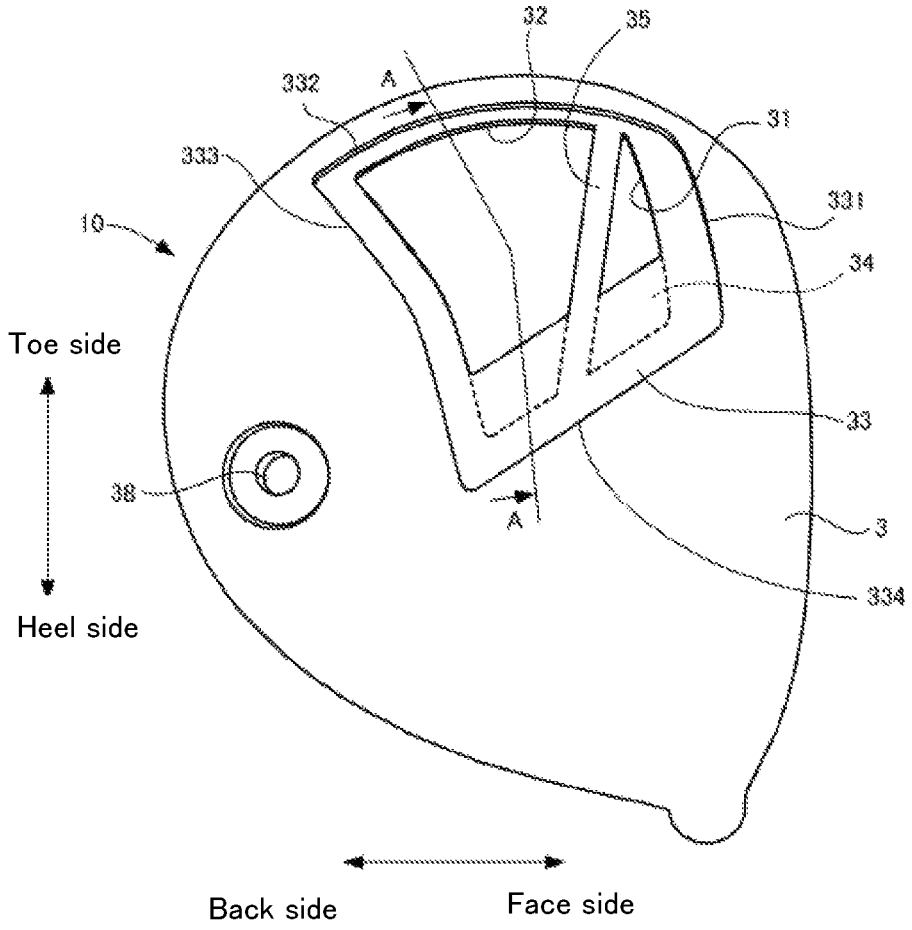
FIG. 5 is a plan view showing a state in which a cover member is removed from a sole portion.

Next, the structure of the outer surface of the sole portion 3 will be described, with reference also to FIG. 5. FIG. 5 is a plan view showing a state in which the cover member is removed from the sole portion.

As shown in FIG. 3 mentioned above, a square-shaped cover member 5 is attached to the sole portion 3, and, as shown in FIG. 5, in the region in which the cover member 5 is attached, a triangular first opening 31 and a square-shaped second opening 32 that is larger than the first opening 31 are formed further on the toe side than the center of the sole portion 3 in the toe-heel direction, and these openings 31 and 32 are in communication with the internal space of the head body 10. Also, a first installation portion 33 and a second installation portion (first thin portion) 34 that the cover member 5 abuts against are formed around these openings 31 and 32, and a partition portion (traverse portion) 35 that the cover member 5 abuts against is formed between the two openings 31 and 32. The cover member 5 is fixed by an adhesive or the like to these portions.

The first installation portion 33 is slightly recessed from the outer surface of the sole portion 3, and is formed in a square frame shape so as to surround the two openings 31 and 32. That is, a step is formed at the boundary between the outer edge of the first installation portion 33 and the outer surface of the sole portion 3. Here, for convenience of description, the face-side outer edge, the toe-side outer edge, the back-side outer edge and the heel-side outer edge of the first installation portion 31 will be respectively referred to as a first edge portion 331, a second edge portion 332, a third edge portion 333 and a fourth edge portion 334. The first edge portion 331 is slightly away from the face portion 1, and extends generally parallel to the face portion 1. The second edge portion 332 is in proximity to the toe-side edge portion of the sole portion 3 and extends in an arc along that edge portion. The third edge portion 333 is formed as a straight line that bends part way along, and the heel-side end portion is located further on the heel side than the heel-side end portion of the first edge portion 331. The fourth edge portion 334 is formed so as to extend on the toe side proceeding toward the face side, while extending in the face-back direction.

The second installation portion 34 is formed in a square shape extending from the first installation portion 33 towards the second edge portion 332, and is formed to be thinner than the first installation portion 33, as will be discussed later. Furthermore, the partition portion 35 extends so as to connect the second edge portion 332 and the fourth edge portion 334 of the first installation portion 33, and the two openings 31 and 32 are partitioned by this partition portion 35. The partition portion 35 is formed so as to extend slightly on the face side proceeding toward the toe side, while extending in the toe-heel direction. Also, a rib 351 is formed on the inner surface of the partition portion 35, that is, on the surface of the partition portion 35 on the internal space side, as will be discussed later.

Note that, on the outer surface side of the head body 10, the first installation portion 33, the second installation portion 34 and the partition portion 35 are formed to be flush without any step, and the cover member 5 is thereby firmly fixed. The height of the step between the first installation portion 33 and the outer surface of the sole portion 3 is generally the same as the thickness of the cover member 5. Accordingly, the outer surface of the cover member 5 will be generally flush with the outer surface of the sole portion 3, when the cover member 5 is attached to the sole portion 3.

Also, in the sole portion 3, a fixing hole 38 for attaching a weight member (illustration omitted) is formed further on the back side than the cover member 5. A female thread (illustration omitted) for screwing in a male thread attached to the weight member is formed in the inner wall surface of the fixing hole 38.

3. Structure of Inner Surface of Sole Portion

Figure 6:
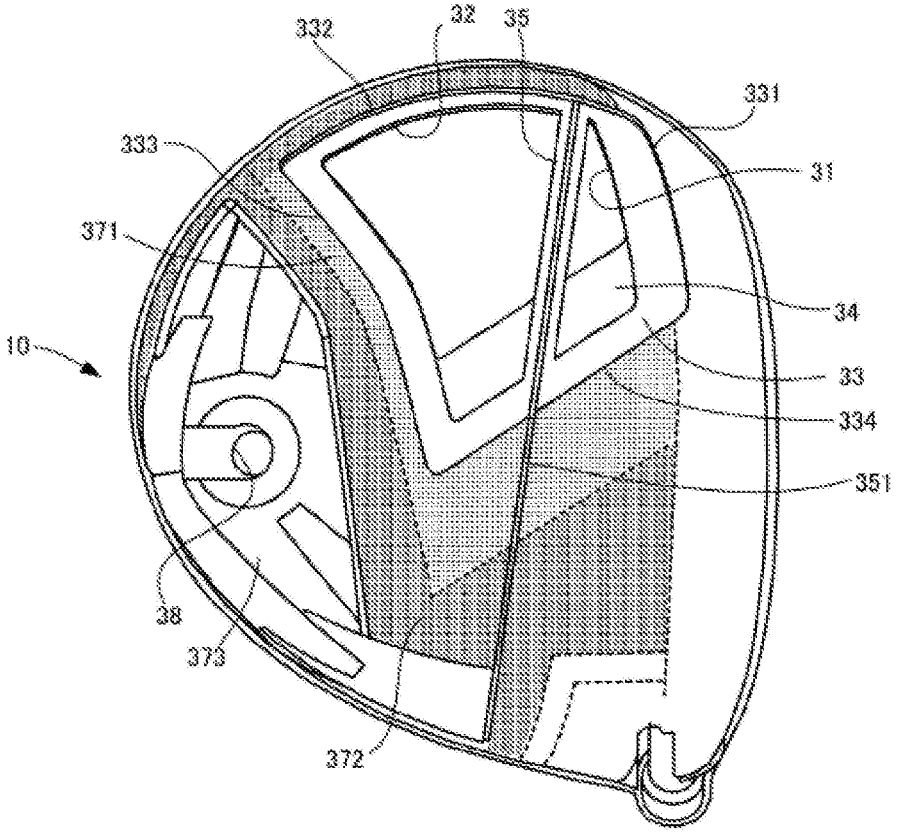
FIG. 6 is a plan view of an inner surface viewed through the sole portion from a lower surface side.

Next, the structure of the inner surface of the sole portion 3 will be described, with reference also to FIGS. 6 to 8. FIG. 6 is a plan view of an inner surface viewed through the sole portion from a lower surface side, FIG. 7 is a perspective view showing the internal space of the head with the head partially cut away, and FIG. 8 is a cross-sectional view along line A-A in FIG. 5.

Figure 7:
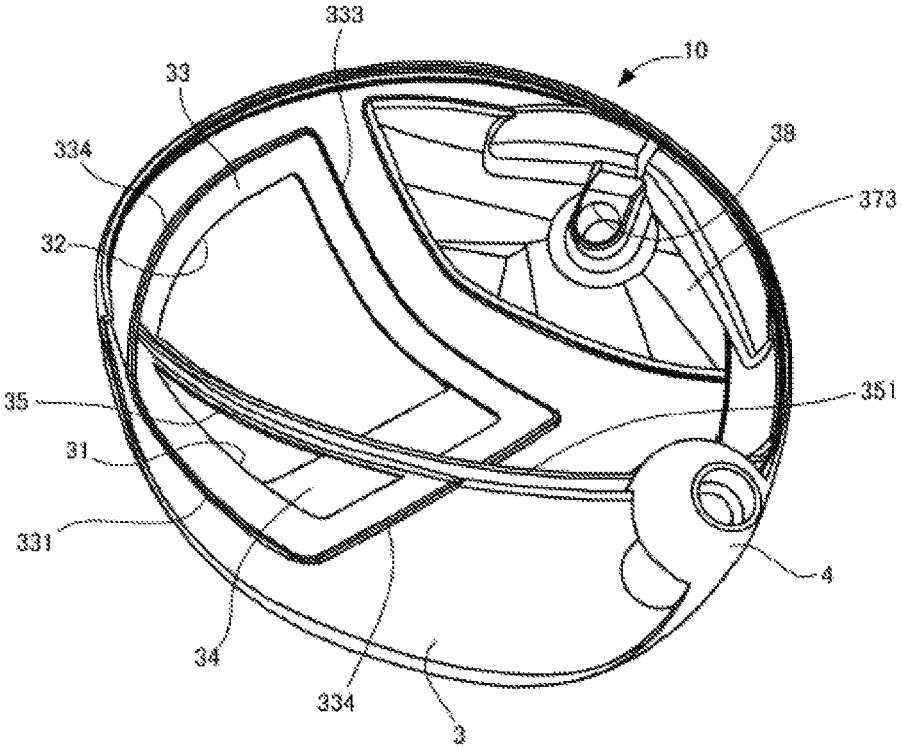
FIG. 7 is a perspective view showing an internal space of the head with the head partially cut away.
Figure 8:
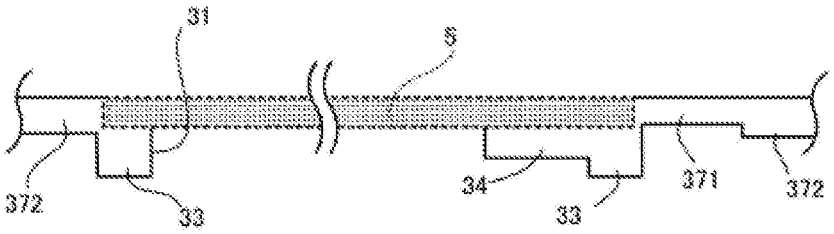
FIG. 8 is a cross-sectional view along line A-A in FIG. 5.

As shown in FIGS. 6 to 8, on the inner surface of the sole portion 3, the first installation portion 33 is a region that mainly supports the cover member 5, and thus the thickness thereof can, for example, be set from 0.4 to 1.0 mm. The partition portion 35 is also the same thickness as the first installation portion 33. On the other hand, the second installation portion 34 is a region that supports the cover member 5, so as to complement the first installation portion 33, and is thus formed to be thinner than the first installation portion 33.

Also, as shown in FIG. 6, in the sole portion 3, a first area 371 (light gray colored portion: second thin portion) formed in an L-shape so as to surround the third edge portion 333 and the fourth edge portion 334 of the first installation portion 33, and, furthermore, a second area 372 (dark gray colored portion: thick portion) formed so as to surround this first area 371 and the second edge portion 332 of the first installation portion 33 are provided in an area further on the outer side than the first installation portion 33. The first area 371 is arranged generally in the vicinity of the middle in the toe-heel direction, and part of the second area 372 is arranged further on the heel side than the first area 371. Also, since part of the second area 372 is arranged further on the toe side than the openings 31 and 32, the second area 372 is arranged on both sides in the toe-heel direction across the openings 31 and 32.

As shown in FIG. 8, the first area 371 is formed to be thinner than the first installation portion 33, and the second area 372 is formed to be thicker than the first area 371 but thinner than the first installation portion 33. Furthermore, a rear area 373 is formed around the fixing hole 38 further on the back side than the second area 372. This rear area 373 is formed so as to follow the edge portion of the sole portion 3 on the back side, and includes a region whose thickness in the sole portion 3 is equivalent to or greater than the first installation portion 33.

As shown in FIGS. 6 and 7, the rib 351 is formed on the inner surface of the sole portion 3. This rib 351 passes through the inner surface of the abovementioned partition portion 35, and further extends on the toe side and the heel side. That is, the toe-side end portion of the rib 351 extends to the second edge portion 332 of the first installation portion 33, and the heel-side end portion extends to the heel-side edge portion of the sole portion 3. Accordingly, the rib 351 extends so as to approach the back side proceeding toward the heel side, rather than extending parallel to the face portion 1.

The width of the rib 351 is narrower than the partition portion 35, and can, for example, be set from 0.5 to 1.5 mm. Also, the height of the rib 351 can, for example, be set to a height of 1.0 to 7.0 mm from the first installation portion 33 and the partition portion 35. As shown in FIG. 7, the height of the rib 351 becomes lower proceeding toward the toe side, and the height from the inner surface of the sole portion is zero at both end portions thereof. Also, from the viewpoint of the hitting sound discussed later, the large rib 351 is preferably formed near the face portion 1, and is, for example, preferably formed in an area within 50 percent of the length of the head 100 in the face-back direction from the face portion 1.

4. Assembly Structure of Golf Club Head

The golf club head 100 according to the present embodiment can be configured to have various assembly structures. For example, a structure can be adopted in which an opening is formed in the face portion 1, and a face member is fitted into this opening and fixed by welding. The face member can, for example, be manufactured by a method such as forging, plate pressing or casting. On the other hand, portions other than the face member can be manufactured by casting such as a well-known lost wax precision casting process.

Alternatively, a so-called cup face structure can also be adopted in which a cup-shaped face member provided with the face portion 1 and a peripheral portion that projects from a periphery of the face portion 1 are formed, and this cup-shaped face member is attached to an opening formed on the face side of the crown portion 2 and the sole portion 3. In this case, the face member can similarly be manufactured by a method such as forging, plate pressing or casting, as mentioned above, and other portions can be formed by a precision casting process such as the above.

Also, the openings 31 and 32 can be formed by cutting the sole portion 3 with a laser or the like, after casting the head or after attaching the face member as mentioned above. Thereafter, the head 100 is completed when the cover member 5 is fixed with an adhesive to the two installation portions 33 and 34 and the partition portion 35.

5. Features

According to the above embodiment, the following effects can be obtained.

(1) Since the openings 31 and 32 are formed in the sole portion 3, and the cover member 5 having a low specific gravity is attached so as to close these openings 31 and 32, the weight of the sole portion 3 can be reduced. Since that saved weight can be distributed to other regions, the flexibility of center of gravity design of the head 100 can be improved. In particular, since the openings 31 and 32 are formed on the toe side, and, furthermore, the thickness of the first area 371 surrounding the first installation portion 33 is made smaller, the weight on the toe side can be reduced. Also, the height of the rib 351 becomes lower proceeding toward the toe side, contributing to the weight reduction on the toe side. On the other hand, since the second area 372 having a large thickness is formed on the heel side, the weight on the heel side can be increased. Accordingly, the head readily returns to square during the swing, and slicing can be reduced.

Note that since the second area 372 is formed on both the toe side and the heel side, sandwiching the openings 31 and 32, the heavy portions are formed in the vicinity of the toe-side and heel-side end portions of the sole portion 3. Accordingly, the moment of inertia of the right and left of the head 100 can be increased.

(2) Since the rear area 373 having a large thickness is formed on the back side of the sole portion 3, the center of gravity depth of the head 100 can be increased. Since the loft angle at the time of impact thereby increases, the launch angle can be increased.

(3) Since the rib 351 is formed so as to traverse between the openings 31 and 32, a decrease in the rigidity of the head caused by the openings 31 and 32 can be suppressed. On the other hand, since the height of the rib 351 becomes smaller proceeding toward the toe side, the increase in weight caused by the rib 351 can be suppressed. As a result, the flexibility of weight distribution can be prevented from being impaired. Also, since the sole portion 3 curves such that the toe side gradually becomes higher, the rib 351 becomes smaller proceeding toward the toe side, enabling the height of the rib 351 from the lowest point of the sole portion 3 to be kept at a low position on the toe side. Accordingly, an increase in the center of gravity of the head due to the weight of the rib 351 can be suppressed, while obtaining the effects of reinforcement by the rib 351.

Also, vibration occurs in the sole portion 3 due to the ball hitting the face portion 1, and a plurality of antinodes of this vibration may occur in the toe-heel direction of the sole portion 3. When the rib 351 extending in the toe-heel direction is formed, so as to pass through the portion where such antinodes of vibration occur, the vibration can be reduced. In particular, antinodes of vibration of low frequency often occur adjacent to the face portion 1, and thus by forming a rib in a position near the face portion 1, as in the present embodiment, such vibration of low frequency can be suppressed, and the pitch of the hitting sound can be increased. Accordingly, vibration of desired frequencies can be suppressed by forming the rib 351 extending in the toe-heel direction.

(4) In the sole portion 3, the first installation portion 33, the second installation portion 34 and the partition portion 35 are formed as a region that contacts the cover member 5. In this way, the joining strength between the head body 10 and the cover member 5 can be improved, by enlarging the area that contacts the cover member 5. Also, the cover member 5 is further reinforced, as a result of the partition portion 35 on which the rib 351 is formed contacting the cover member 5. Also, since the cover member 5 is generally formed with a material of lower rigidity than the head body 10, vibration thereby tends to occur with a low vibration frequency when the ball is hit. Thus, a low pitched hitting sound tends to occur. In contrast, as mentioned above, when the cover member 5 is reinforced, vibration of low vibration frequency can be suppressed. As a result, vibration of high vibration frequency can be produced, and the hitting sound can be configured to be high pitched.

6. Variations

Although an embodiment of the present invention has been described above, the present invention is not limited to the above embodiment, and various modifications can be made without departing from the spirit of the invention. Also, the following variations can be combined as appropriate. For example, the following modifications can be made.

6-1. The openings 31 and 32 are not particularly limited in terms of shape, position and number, and can, for example, also be formed on the heel side or the back side. Also, in the above embodiment, two installation portions 33 and 34 and a partition portion 35 that the cover member 5 abuts against are formed, and the shape of the area that the cover member 5 abuts against is not particularly limited.

6-2. Also, in the above embodiment, the first installation portion 33 is formed so as to be recessed from the outer surface of the sole portion 3, and the cover member 5 and the outer surface of the sole portion 3 are thereby formed to be flush. In contrast, for example, the cover member 5 can also be adhered to the outer surface of the sole portion 3 on the outer side of the openings 31 and 32, without forming the first installation portion 33 recessed from the outer surface of the sole portion 3. Although a step will thereby be formed between the cover member 5 and the outer surface of the sole portion 3, such a mode is also possible.

6-3. The rib 351 need only be formed so as to pass between at least the two openings 31 and 32. Alternatively, it can also be said that the rib 351 need only be formed so as to traverse one opening. Accordingly, the number and position of ribs is not particularly limited. For example, in the above embodiment, the rib 351 passes beyond the openings 31 and 32 and extends on the toe side and the heel side, but can also be formed only in the vicinity of where the openings 31 and 32 are traversed.

In the above embodiment, the height of the rib 351 becomes lower proceeding toward the toe side, but may become lower proceeding toward the heel side. Similar effects to the effects resulting from the rib 351 becoming lower proceeding toward the toe side can thereby be obtained. Also, the height of the rib 351 may change incrementally, or a configuration can also be adopted in which the height is changed by providing a step. Additionally, the height of the rib 351 is not particularly limited, and the portion that is lowered can be changed as appropriate according to factors such as the center of gravity design corresponding to the performance that is required. That is, weight can be arranged at a desired position by adjusting the height of the rib 351.

Also, the rib 351 and the partition portion 35 of the present embodiment constitute a bridge portion of the present invention, and the portion that abuts against the cover member 5 in the partition portion 35 constitutes a joining surface of the present invention. A configuration can also be adopted in which the bridge portion is formed with only the rib 351 without providing the partition portion 35, and the rib 351 abuts against the cover member 5. In this case, the portion of the rib 351 that abuts against the cover member 5 corresponds to the joining surface of the present invention. Alternatively, the bridge portion can also be formed with only the partition portion 35.

6-4. The thickness of the sole portion 3 is not limited to that shown in the above embodiment, and various thickness distributions can be configured. For example, the first area 371 need only be formed at least partially around the openings 31 and 32 or the first installation portion 33. The shape of the second area 372 is also not particularly limited.

6-5. In the above embodiment, the openings 31 and 32 are formed in the sole portion 3, but can also be formed in the crown portion 2. Since the crown portion 2 is, however, generally smaller in thickness compared with the sole portion 3, the weight reduction effects obtained by forming the openings 31 and 32 is considered to be higher when forming the openings in the sole portion 3. Also, in the case of forming the openings in the crown portion 2, the position and number of openings, the mode for installing the cover member 5 and the mode of the bridge can be changed as appropriate similarly to the case of forming openings and a bridge in the sole portion 3. Alternatively, openings and a bridge portion can also be formed in both the sole portion 3 and the crown portion 2.

LIST OF REFERENCE NUMERALS

1 Face portion
2 Crown portion
3 Sole portion
31 First opening
32 Second opening
33 First installation portion
34 Second installation portion (first thin portion)
35 Partition portion (traverse portion)
351 Rib (bridge portion)
371 First area (second thin portion)
372 Second area (thick portion)
5 Cover member

What is claimed is:

1. A golf club head comprising:
a head body having a face portion, a crown portion and a sole portion: and
a cover member attached to the head body and having a specific gravity smaller than the head body,
wherein the head body has:
an internal space surrounded by the face portion, the crown portion and the sole portion, and includes:
an opening formed in at least one of the crown portion and the sole portion and in communication with the internal space, and
a bridge portion having a traverse portion that traverses at least the opening and extending along an inner wall surface of the head body,
the opening is closed by the cover member from an outer side of the head body,
the bridge portion includes a joining surface that contacts the cover member, and
a height of the bridge portion from the inner wall surface of the head body changes in a direction in which the bridge portion extends;
wherein the bridge portion extends in a toe-heel direction to a vicinity of a toe-side edge portion of the sole portion, and
the height of the bridge portion becomes lower proceeding toward the toe-side edge portion of the sole portion.

2. The golf club head according to claim 1,
wherein an installation portion on which a peripheral portion of the cover member is arranged is formed on a peripheral portion of the opening,
a step is formed at a boundary between an outer edge of the installation portion and an outer surface of the head body, and
the golf club head is constituted such that the peripheral portion of the cover member arranged on the installation portion is substantially flush with the outer surface of the head body.

3. The golf club head according to claim 2, wherein a second installation portion having a small thickness is formed in part of the installation portion.

4. The golf club head according to claim 2, wherein, in the head body, a thin portion having a smaller thickness than the installation portion is formed at least partially around the installation portion.

5. The golf club head according to claim 4, wherein a thick portion having a larger thickness than the thin portion is formed at least partially around the thin portion.

6. The golf club head according to claim 5, wherein the thick portion is formed on the toe side and the heel side, sandwiching the opening.

7. The golf club head according to claim 1,
wherein the bridge portion extends in the toe-heel direction,
the opening is partitioned by the bridge portion that extends in the toe-heel direction into a first opening on a face side and a second opening on a back side, and
the first opening has a smaller area than the second opening.

8. The golf club head according to claim 1, wherein the opening is formed on the toe side in the toe-heel direction.

9. The golf club head according to claim 1, wherein the opening is formed in the sole portion.

10. A golf club head comprising:
a head body having a face portion, a crown portion and a sole portion: and
a cover member attached to the head body and having a specific gravity smaller than the head body,
wherein the head body has:
an internal space surrounded by the face portion, the crown portion and the sole portion, and includes:
an opening formed in at least one of the crown portion and the sole portion and in communication with the internal space, and
a bridge portion having a traverse portion that traverses at least the opening and extending along an inner wall surface of the head body,
the opening is closed by the cover member from an outer side of the head body,
the bridge portion includes a joining surface that contacts the cover member, and
a height of the bridge portion from the inner wall surface of the head body changes in a direction in which the bridge portion extends;
wherein
an installation portion on which a peripheral portion of the cover member is arranged is formed on a peripheral portion of the opening,
a step is formed at a boundary between an outer edge of the installation portion and an outer surface of the head body,
the golf club head is constituted such that the peripheral portion of the cover member arranged on the installation portion is substantially flush with the outer surface of the head body, and
in the head body, a thin portion having a smaller thickness than the installation portion is formed at least partially around the installation portion.

11. The golf club head according to claim 10,
wherein the bridge portion extends in a toe-heel direction to a vicinity of a toe-side edge portion of the sole portion, and
the height of the bridge portion becomes lower proceeding toward the toe-side edge portion of the sole portion.

12. The golf club head according to claim 10, wherein a thick portion having a larger thickness than the thin portion is formed at least partially around the thin portion.

13. The golf club head according to claim 12, wherein the thick portion is formed on the toe side and the heel side, sandwiching the opening.

14. The golf club head according to claim 10,
wherein the bridge portion extends in the toe-heel direction, the opening is partitioned by the bridge portion that extends in the toe-heel direction into a first opening on a face side and a second opening on a back side, and the first opening has a smaller area than the second opening.

15. The golf club head according to claim 10, wherein the opening is formed on the toe side in the toe-heel direction.

16. The golf club head according to claim 10, wherein the opening is formed in the sole portion.

* * * * *